United States Patent [19]

Pilling

[11] Patent Number: 4,490,917

[45] Date of Patent: Jan. 1, 1985

[54] VEHICLE DOCKER

[76] Inventor: James T. Pilling, 762 Redding Way, Upland, Calif. 91786

[21] Appl. No.: 453,774

[22] Filed: Dec. 27, 1982

[51] Int. Cl.[3] ..... B60R 27/00; G01C 15/00; B60Q 9/00

[52] U.S. Cl. ..... 33/264

[58] Field of Search ..... 116/28 R, 114, 122, 116/94, 100; 33/392, 393, 264; 242/125.1, 125.12, 125.13; 24/115 F, 115 G, 115 K, 115 A

[56] References Cited

U.S. PATENT DOCUMENTS

| | | | |
|---|---|---|---|
| 2,166,520 | 6/1939 | Challoner | 40/128 |
| 2,854,942 | 10/1958 | Ross | 116/28 |
| 3,011,263 | 12/1961 | Unger | 33/217 |
| 3,165,143 | 1/1965 | Jackwig | 160/189 |
| 3,439,728 | 4/1969 | Martini | 158/193 |
| 3,793,981 | 2/1974 | Sparks | 116/28 R |
| 3,817,203 | 6/1974 | Brauer | 116/28 R |
| 3,844,050 | 10/1974 | Lynn | 116/28 R |
| 3,874,322 | 4/1975 | Brauer | 116/28 R |

*Primary Examiner*—Willis Little
*Attorney, Agent, or Firm*—Leo R. Carroll

[57] ABSTRACT

A vehicle docking aid is disclosed in which a docking indicator is suspended by cord means attached to the door or wall of a garage. Intermediate hooking means are provided to raise the indicator out of the way when the garage is empty and the door is up. When hooked to the top of the garage door, the indicator is automatically disengaged when the door is lowered and the indicator thus returns to its normal position.

1 Claim, 6 Drawing Figures

VEHICLE DOCKER

BACKGROUND OF THE INVENTION

This invention relates generally to vehicle parking aids used to indicate proper docking of a vehicle within an enclosure and more specifically, to positioning indicator means which may be lowered by opening motion of a garage door.

Methods of preventing overshoot when parking a car in a garage by means of a suspended ball-type indicator are well known. J. A. Ross, in U.S. Pat. No. 2,854,942, shows a ball-like warning device, cord suspended from the ceiling and positioned to contact the vehicle windshield when the car is properly positioned. In U.S. Pat. No. 3,793,981, M. P. Sparks provides a means of better estimating the overshoot distance by comparing the motion of a ball indicator impinging the hood of a car with that of a second vertically fixed plumb-bob line. In U.S. Pat. Nos. 3,817,203 and 3,874,322, W. A. Brauer teaches methods of connecting the suspended ball to the movement of a sliding garage door. He thus solves the problem of interference of the suspended ball with use of the garage area when the car is not parked in the area. By lowering the door, the ball is raised up out of the way. Not solved, however, is the problem of interference of the suspended ball with other garage uses when the overhead garage door must remain open. Also, those fixed systems without an overhead door lifting arrangement are unable to partake of the Brauer improvements. My invention solves these problems by providing additional means of raising or placing the docking indicator in a remote position independent of garage door movement.

SUMMARY OF THE INVENTION

The improvement provided by my invention involves the use of an intermediate loop or ring positioned along the cord supporting the docking indicator. This loop can be placed over a hook assembly which can be mounted on either the garage door or on garage fixed structure. When so placed, the indicator is raised or is laterally displaced so as to not cause interference with garage use even though the door is raised. When the door is lowered, the indicator returns to the normal position.

Multiple hooks may be placed around the garage, or multiple loops or rings can be placed along the cord. When so used, the initial positioning of the indicator may be easily and quickly adjusted for variations in dimensions of the vehicle or in the type of vehicle being docked.

It is, therefore, a primary object of this invention to provide a vehicle positioning indicator system in which the indicator may be raised to a non-interference position when the door is opened and automatically returned when the door is closed.

It is further object of this invention to provide means of raising the indicator in a vehicle positioning indicator system which is fixed mounted to the wall instead of to the door.

It is a further object of this invention to disclose a docker raising improvement which can be easily added by modification to existing car positioning systems.

It is a further object to provide a system in which the docking indicator may be easily adjusted in accordance with different car sizes.

It is a further object to provide a simple low cost adjustable positioning device to be used for car docking.

DESCRIPTION OF THE PREFERRED EMBODIMENT

Figure 1:
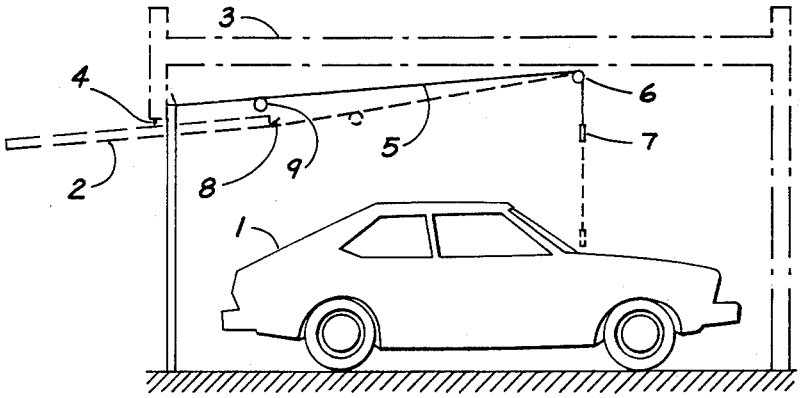
FIG. 1 is a side elevational view of the door attached device in use with a car positioned in place in a closed door garage.

FIG. 1 contains a side view of an automobile in place in a closed garage with the vehicle parking docker in place. As shown, Car 1 is positioned within garage 3 with garage door 2 in the vertical or closed position. Said garage door 2 pivots at the position of door pivot 4 when raised to the horizontal or open position shown in phantom.

A cylindrical docking indicator 7 is suspended at the end of cord 5 such that visible impending contact will be made with car 1 when the door is in the raised position shown in phantom. The opposite end of cord 5 is attached to and moves with garage door 2. In between said cord ends said cord is suspended and guided by cord pully means 6, which is rigidly fixed to the ceiling structure of garage 3. The ceiling mounting point will be placed directly over the desired contact point between indicator and car. The indicator will hang from the pully under normal gravity forces.

The indicator may be sperical, oblong or any shape. In one enbodiment, the cylindrical docking indicator is hollow, made of plastic or cardboard, and is brightly painted with a reflective paint in order to enhance visability at night.

A cord loop 9 is provided on said cord 5 between said pully 6 and said cord end attaching to said garage door 2. Said cord loop can consist, or course, of a separately attached ring made of plastic, wood or metal. In such a case, the attachment will be preferably by a simple slip knot, so that the ring may rotate within the knot. A hook assembly 8 is rigidly attached to the top of said garage door 2, with the purpose of receiving cord loop 9 whenever it is desired to raise indicator 7 when said door 2 is open.

Figure 2:
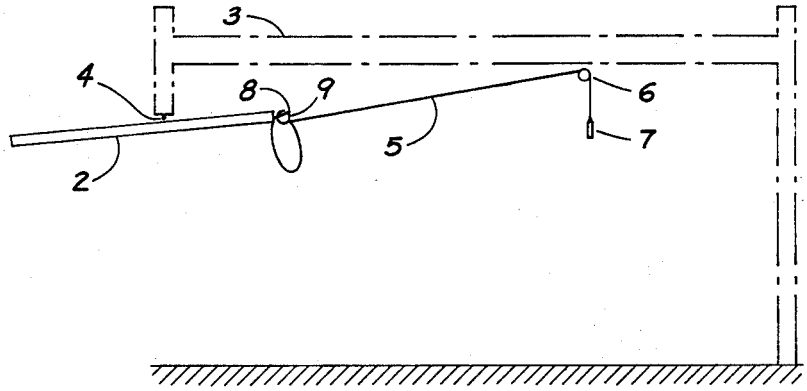
FIG. 2 is a side elevation view of the garage area with the door and docking indicator both raised.

FIG. 2 shows a side view of the empty garage with the door raised and the indicator raised to an overhead position. Cord loop 9 has been connected to the hook assembly 8 resulting in ball 7 being raised to an out of the way position with garage door 2 in the open position.

It is also understood that cord loop 9 can be positioned along the cord between pully 6 and docker indicator 7. Likewise hook assembly 8 can be fixed mounted to the garage structure rather than to the door top. When so arranged, the indicator is permanently stowed away in the up position and decoupled from door movement.

It is further understood that a plurality of cord loops could be spaced along the length of the cord. Likewise a plurality of hook assemblies can be placed at different locations within the garage. When so arranged, the docking or lowered position of the docker indicator may be adjusted for type of vehicle and for particular vehicle dimensions.

Figure 3:
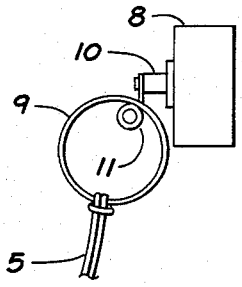
FIG. 3 is a top enlarged view looking down on the hook assembly with hook engaged.

FIG. 3 denotes a top view of the hook assembly. A vertical hook post 11 is shown end on, connected to the hook assembly 8 by means of hook post support 10. Cord loop 9 is illustrated in the hooked position over hook post 11.

Figure 4:
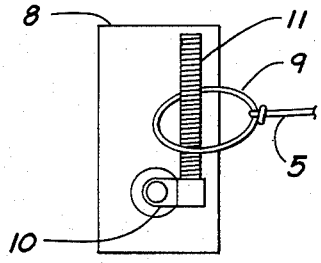
FIG. 4 is a front perspective view of the hook assembly with hook engaged.

FIG. 4 shows a front perspective view of hook assembly 8 previously given in FIG. 3. The hook post support 10 is a solid metal structure rigidly attached to assembly 8. The hook post 11 is shown in one imbodiment to consist of a vertical light wound spiral spring, over which cord loop 9 is placed. When so made, sufficient bending flexibility is provided to prevent cord breakage and ease unhooking when the door is lowered while the cord loop is still hooked. This configuration thus provides a release mechanism such that the loop will be slipped off and the docker indicator will be automatically returned to the initial docking position.

Figure 5:
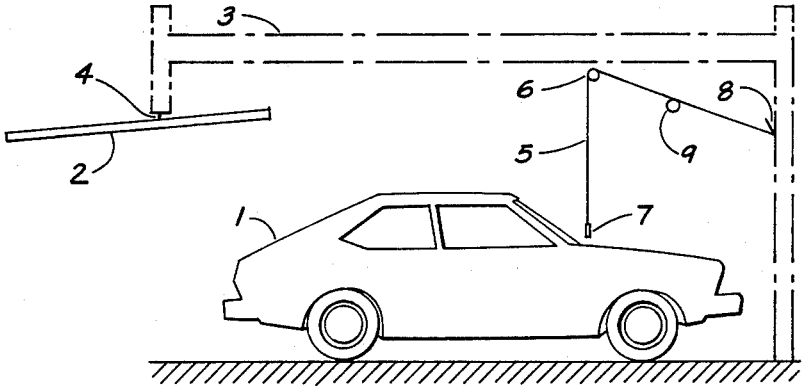
FIG. 5 is a side elevational view of the wall attached device in use with a car positioned in place in an open door garage.
Figure 6:
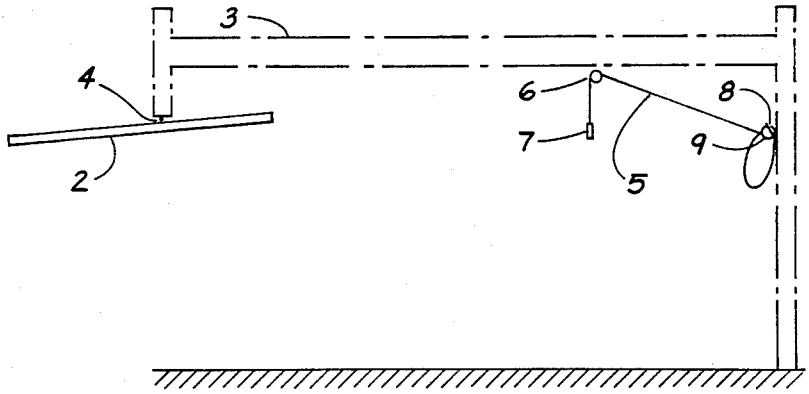
FIG. 6 is a side view with indicator hooked.

FIG. 5 presents an additional side view of the car in the garage with the door in the raised position. The car docker arrangement is now fixed to the garage rather than the door. As shown cord 5 end opposite docker 7 is fixed attached to garage 3 side structure at the same point as hook assembly 8 is mounted. Indicator 7 is shown in the lowered position just after the arriving car 1 has docked. After leaving, indicator 7 may be conveniently raised out of the way by manually hooking cord loop 9 over hook post 11 mounted on the hook assembly 8. FIG. 6 shows such an arrangement wherein movement around the empty garage will not be impeded by the hanging indicator. With the flexible post the hook can be disengaged by simply pulling the indicator downward. Although hook assembly 8 is mounted on a rear wall of the garage as illustrated, side walls or the interior roof structure could likewise have been used.

In operation, the improvement consisting of providing a cord loop and a flexible hook assembly completely solves the problem of interference with a lowered indicator when the door is raised. When placed on the door, closure of the door causes automatic hook disengagement with a resultant return of the indicator to the normal docking position. This simple arrangement also provides operator flexibility in regard to when and where to stop, at a minimum cost.

It is to be understood that the foregoing description is merely illustrative of the preferred embodiment of the invention and that the scope of the invention is not to be limited thereto, but is to be determined by the scope of the appended claims.

What I claim is:

1. A vehicle parking docker, comprising:

a suspended docking indicator whereby contact between the indicator and a vehicle may be visually observed to indicate accurate docking;

means for suspending said indicator, having two ends and providing vertical cord support for said indicator from one end;

means to support and guide cord support means;

means to attach said cord support end opposite said indicator to an overhead garage door, a plurality of cord loops spaced apart and connected to said means for suspending said indicator, and a plurality of hook assemblies attached to a garage enclosure member whereby any cord loop may be flexibly attached to any said hook assembly to change the position of said docking indicator, wherein at least one said hook assembly is attached to said overhead garage door and contains a flexible post over which a cord loop may be placed when said door is opened and which will bend to release said cord loop when said door is closed.

* * * * *